United States Patent [19]

Gasiel et al.

[11] Patent Number: 4,917,264

[45] Date of Patent: Apr. 17, 1990

[54] DOUBLE-DEPTH MODIFIED SERPENTINE CAN VENDER

[75] Inventors: Joseph F. Gasiel, Peru; Paul L. Hawkins; Jeffery J. Wilson, both of Guthrie Center, all of Iowa

[73] Assignee: Fawn Engineering Corp., Des Moines, Iowa

[21] Appl. No.: 291,005

[22] Filed: Dec. 27, 1988

[51] Int. Cl.[4] ..... B65H 3/44

[52] U.S. Cl. ..... 221/124; 221/130; 221/131; 221/133; 221/194; 221/289; 221/298; 221/299; 221/312 R; 193/27; 312/45; 312/49; 312/72

[58] Field of Search ..... 221/67, 124, 92, 123, 221/129, 130, 131, 133, 194–196, 237, 241, 251, 258, 277, 289, 290, 297, 298, 299, 222, 236, 201, 312 R; 193/27, 28; 211/59.2; 312/45, 49, 42, 73, 72

[56] References Cited

U.S. PATENT DOCUMENTS

| | | | |
|---|---|---|---|
| 1,803,146 | 4/1931 | Robbins | 221/312 R |
| 3,379,294 | 4/1968 | Van Liew, Jr. . | |
| 3,498,497 | 3/1970 | Baxendale et al. | 221/116 |
| 3,831,806 | 8/1974 | Lindsey | 221/1 |
| 4,347,952 | 9/1982 | Bookout | 221/129 |
| 4,632,257 | 12/1986 | Negishi et al. | 211/59.2 |
| 4,779,760 | 10/1988 | Wittern et al. | 221/283 |
| 4,823,983 | 4/1989 | Groover et al. | 312/45 X |

FOREIGN PATENT DOCUMENTS

| | | | |
|---|---|---|---|
| 0052888 | 6/1982 | European Pat. Off. | 221/124 |
| 52-37095 | 3/1977 | Japan | 221/131 |

*Primary Examiner*—Kevin P. Shaver
*Assistant Examiner*—David H. Bollinger
*Attorney, Agent, or Firm*—Henderson & Sturm

[57] ABSTRACT

An article dispensing machine (10) comprising a cabinet (12) containing a plurality of upstanding columns (14),(15),(16) each of which includes a first serpentine track unit (17) having an upper article receiving end (19) and a lower article dispensing end (21), the first track unit (17) having serpentine track sections overlying each other in contiguous relationship, a second track unit (22) including an upper serpentine section (23) disposed above the first track unit (17) and including also a rear substantially straight, vertically disposed track section (26) connected to the lower end of the upper section (23) and disposed behind said first track unit (17) and having a lower article dispensing end (27), and article dispensing control units (28),(29) at the lower dispensing ends of said first and second track units, each control unit selectively pushing and lifting an article (18),(18') to be dispensed for aiding the release thereof.

7 Claims, 5 Drawing Sheets

DOUBLE-DEPTH MODIFIED SERPENTINE CAN VENDER

TECHNICAL FIELD

The present invention relates generally to a dispensing or vending machine for canned beverages or other cylindrical articles which machine is comprised of one or more upright columns for article storage and dispensing. Each column includes a pair of back-to-back article holding track units, each unit having an upper article receiving end and a lower article dispensing end, and article dispensing mechanisms at the lower article dispensing ends of the track units.

BACKGROUND ART

The capacity of product dispensing or vending machines may obviously be increased by adding additional columns and increasing the width of the machine cabinet. However, the width of the cabinet of the dispensing or vending machine is limited as a practical matter due to space considerations at the installation site and the desire on the part of the manufacturer of the machine to utilize existing cabinet structures for economy. Therefore, more efficient use of cabinet depth is often times the only practical way to increase the capacity of the machine and has led to the development of multiple depth vending machines.

One form of multiple depth vending machines is that of a double serpentine arrangement of columns or guide tracks for holding and dispensing articles. It has been found, however, that there is some cabinet space lost particularly in the rear of the cabinet by this arrangement, and to obviate such a loss of space is this invention directed.

The efficiency of such a serpentine arrangement also depends to a certain extent upon a mechanism for controlling the dispensing of the articles at the lower end of each column or guide track, these mechanisms are normally coin activated and controlled. This type of mechanism normally holds the forwardmost article in each column in place until the mechanism is coin activated to release that article, the next adjacent article then being held, and released in like manner, with only gravity aided discharge.

DISCLOSURE OF THE INVENTION

An article dispensing machine which has a rectangular frame including sides, back and an open front containing a plurality of upright article holding columns in a side-by-side arrangement, each column comprising a front serpentine guide track with an upper article receiving end and a lower article dispensing end; and comprising further a rear semi-serpentine guide track, the upper section of which is serpentine over the front track and has an article receiving end, and the rear section of which is substantially vertically disposed with offset portions to obviate a free fall of articles therein and having an article discharge end. Article release mechanisms are provided at each discharge end for controlling the dispensing, and further for aiding the gravity discharge of the articles to prevent binding or hanging up of the articles.

It is an object of this invention to provide a new and novel article dispensing machine of a double depth type.

It is another object of this invention to provide an improved article dispensing machine wherein each upright column can hold a pair of different articles for independent selective discharge at the lower end of the column.

It is still another object of this invention to provide a modified double-depth article holding serpentine column utilizing the entire width and depth of the cabinet for the machine.

Yet another object of this invention is to provide an article dispensing machine utilizing modified upright, double-depth serpentine guide tracks in a single column, the columns side-by-side, wherein a pair of article release units are provided each at a discharge end of the guide tracks, each unit capable of aiding the gravity discharge of articles within each guide track.

Still another object of this invention is to provide an article discharge unit capable of both pushing and lifting an article held by the unit prior to discharge for aiding the discharge of the article.

Yet another object of this invention is to provide such an article dispensing machine which is simple and rugged, easy to manufacture, effective in operation and easily removable for servicing.

BRIEF DESCRIPTION OF THE DRAWINGS

These and other objectives of the invention will become more clear upon a thorough study and review of the following detailed description of the preferred embodiment for carrying out the invention particularly when reviewed in conjunction with the accompanying drawings, wherein.

BEST MODE FOR CARRYING OUT THE INVENTION

Figure 1:
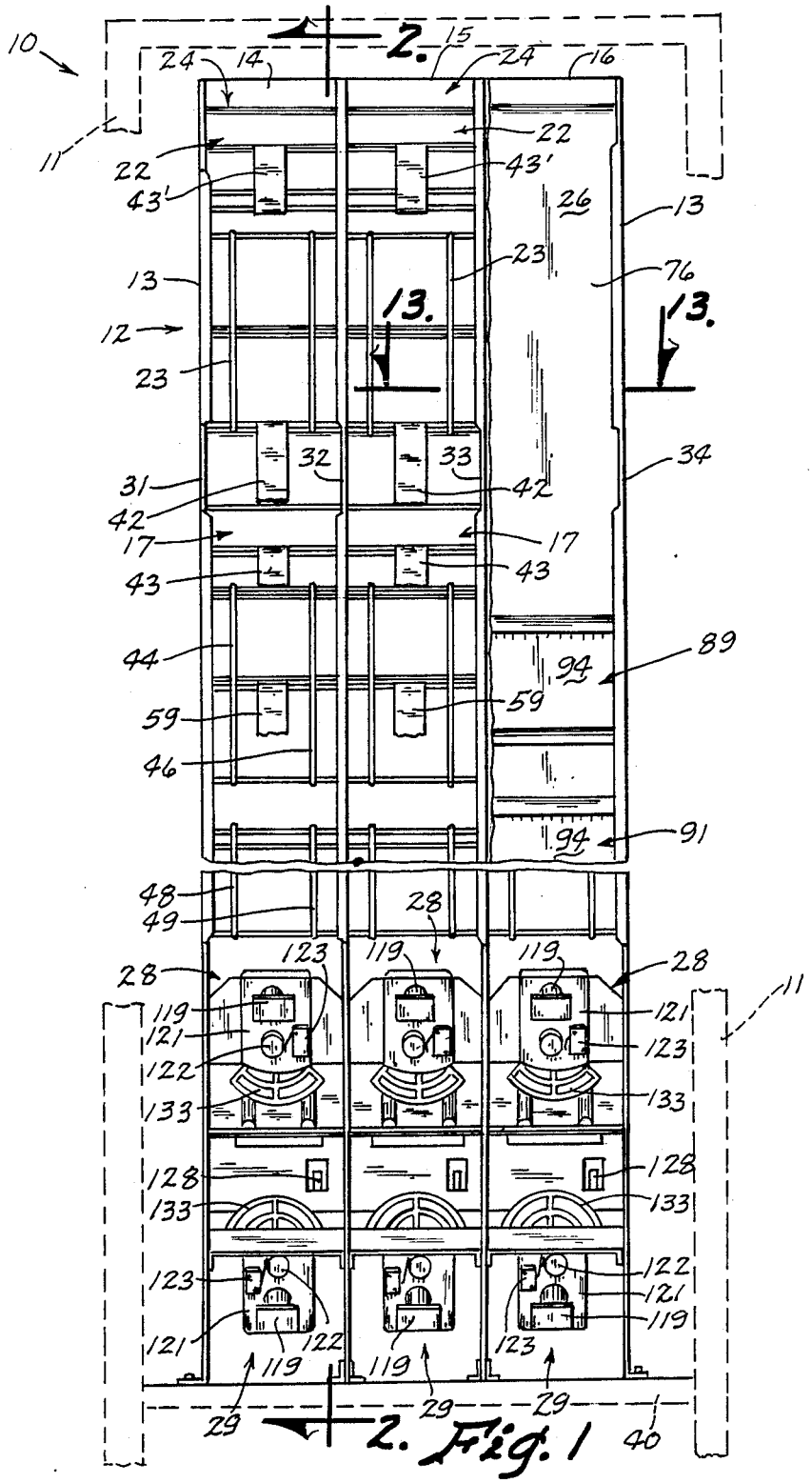
FIG. 1 is a front elevational view of an upright cabinet of a vending machine for using the double-depth modified serpentine column arrangement, parts of the housing of the machine shown in dotted lines.
Figure 2:
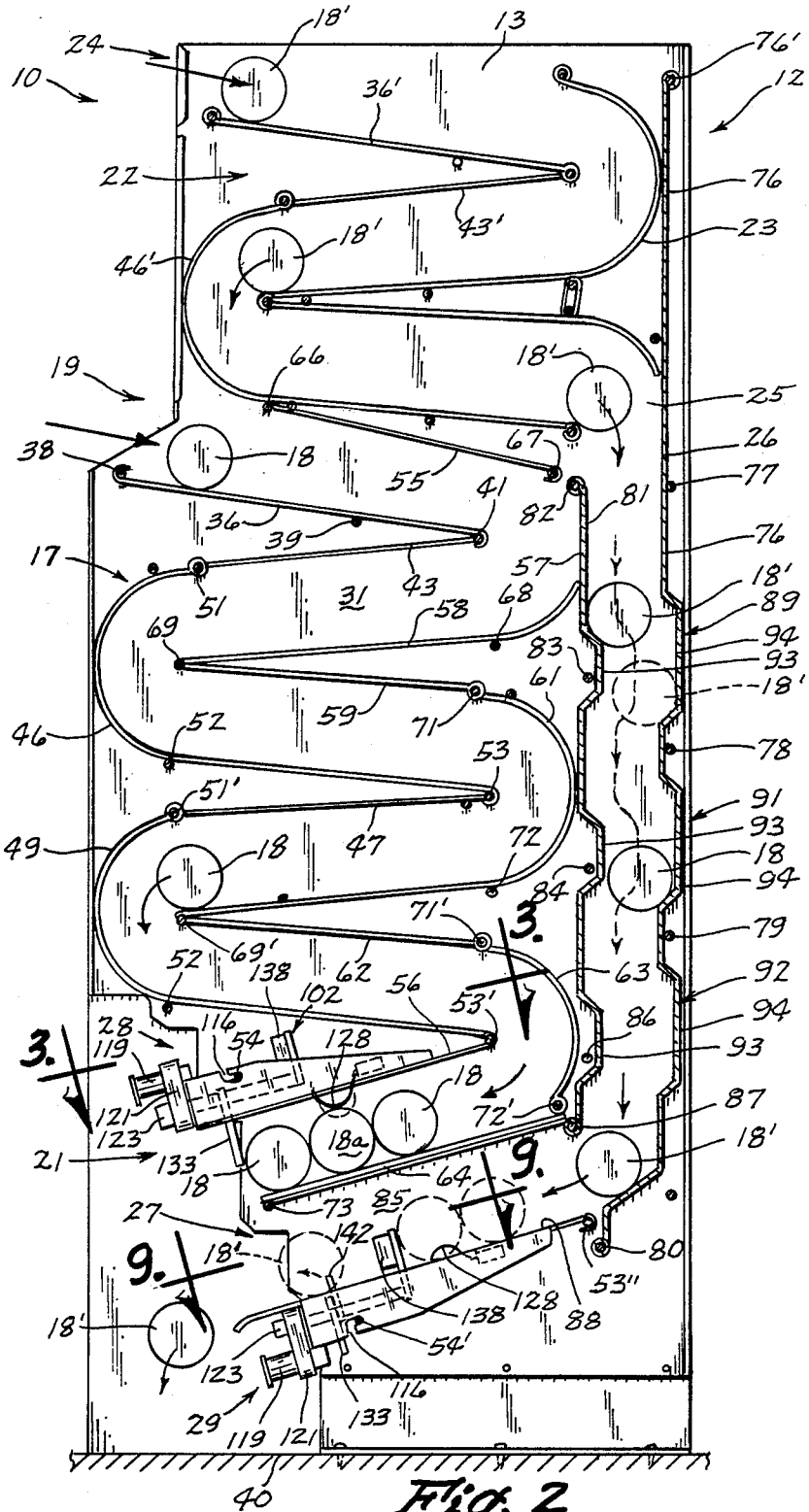
FIG. 2 is a vertical sectional view taken along the lines 2—2 in FIG. 1.

Referring now to the drawings wherein like reference numerals designate identical or corresponding parts throughout the several views, FIGS. 1 and 2 show a vending machine (10) constructed to utilize the present invention. The vending machine (10) has an outer housing (11) of conventional type for holding a rectangular cabinet (12) with side walls (13) and open at the rear and front.

The cabinet (12) includes a plurality of upright columns (14), (15), (16) in a side-by-side arrangement, each column, (14) for example, including a first track unit (17)(FIG. 2) of serpentine configuration for holding a plurality of articles (18), track unit (17) having an upper article receiving end (19) and a lower article receiving end (21). The column (14) includes further a second track unit (22) also for holding a plurality of articles (18') which may be of a different size than articles (18), which track unit (22) includes an upper section (23) of serpentine configuration disposed above the first track unit (17)(FIG. 2) and having an upper article receiving end (24).

The second track unit (22) includes further a rear track section (26) open to the upper section (23) at (25)(FIG. 2) for receiving an article (18') therefrom and which rear track section (26) is disposed behind the first track unit (17) and has a lower article dispensing end (27) contiguous with and disposed below the dispensing end (21) of the first unit (17). A pair of identical article release units (28),(29)(FIGS. 1 and 2) are secured to the cabinet (12) in a manner hereinafter described and each unit (28),(29) of which is mounted in connection with each dispensing end (21),(27) respectively for controlling the dispensing of articles (18),(18') therefrom.

Figure 13:
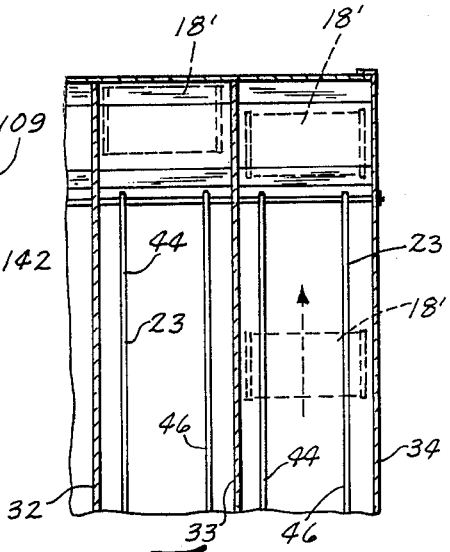

More particularly, the columns (14),(15),(16) are formed by upright laterally spaced wall panels (31),(32),(33) and (34)(FIGS. 1 and 13), panels (31) and (34) being the outer wall panels of the cabinet (12). Fastening devices (35)(FIG. 1) are provided at the base of each wall panel for securement thereof to a floor (40) of the housing (11). Each first track unit (17) is identical and has at its front portion a pair of straight wire forms (36)(FIGS. 1 and 13) secured in parallel, laterally spaced, rearwardly and downwardly sloping arrangement by a trio of rods (38),(39),(41) secured at their outer end (42)(FIG. 1) to the outer wall panels (31),(34) and extended in a parallel, laterally extended manner across the cabinet (12) and through the inner wall panels (32),(33), being spot welded, for example, to the forms (36).

The front portion of the first track unit (17) includes further a forwardly and downwardly disposed strap element (43) joined with a pair of J-shaped wire forms (44),(46) vertically aligned with the forms (36), another strap element (47) connected to the lower end of the forms (44),(46), and yet another pair of J-shaped wire forms (48),(49)(FIG. 2) directly below the forms (44),(46). These elements are again supported in their serpentine configuration by appropriate laterally disposed wire rods (51),(52)(53) and (51')(52')(53'). The front portion of the first track unit (17) is completed by the article release unit (28) being secured by a pair of rods (53'),(54)(FIG. 2) such that a flat surface (56) of the unit (28) serves as the upper wall of the track unit (17) at its dispensing end (21) as will be seen in more detail hereinafter.

The rear portion of the first track unit (17) is comprised of an inwardly and downwardly disposed strap (55), a front wall portion (57)(FIG. 2) of the rear track section (26), a pair of slightly curved forwardly and downwardly disposed wire forms (58) directly below the strap (43)(FIG. 2) and vertically aligned with the wire forms (36), a strap (59) vertically aligned with the strap (43), a pair of J-shaped wire forms (61), another strap (62),and a pair of semi-circular wire forms (63) joined to a panel (64) at the bottom, all spaced vertically and horizontally from the wire forms and straps of the front portion to form thereby a track of a serpentine configuration for articles (18) to roll downwardly therethrough and therebetween by gravity. Again, the straps, wire forms and panel described hereinbefore are supported in the serpentine forming guide path for article (18) by appropriate laterally mounted rods (66),(67),(68),(69),(71),(72),(69'),(71'), (72'), and (73)(FIG. 2). The articles (18) stacked up at the lower article dispensing end (21) are supported on the panel (64) for selective controlled discharge by the article release unit (28).

Referring again to FIGS. 1, 2 and 13, the second article guide track unit (22) comprises an upper section (23) at the upper article receiving end (24) formed in much the same serpentine configuration and by the same type of wire forms, straps and lateral rods as described hereinbefore for the first track unit (17). Thus, a pair of inwardly and downwardly disposed wire forms (36') form the floor of the track unit (22) at the entrance (24), joined by a strap (43') and a pair of J-shaped forms (44'),(46'), the rear portion formed by J-shaped forms (61') and slightly curved forms (58'), all supported by like lateral rods as the first track unit (17). Thus, the upper section (23) of the second track unit (22) is of serpentine configuration and is mounted above and slightly offset inwardly (FIG. 2) of the first unit (17) for forming the article receiving end (21) thereof for easy article access.

The rear track section (26) of the second track unit (22) is article-connected to the upper section (23) and comprises a rear panel (76)(FIGS. 1 and 2) extended the entire width of each column and disposed vertically as best shown in FIG. 2, being held in place by lateral rods (76'),(77),(78),(79) and (80) extended across the cabinet (12) in the same arrangement as the serpentine mounting rods (38) etc. Forwardly of the rear panel (76), a front panel (81) is mounted as by rods (82),(83),(84),(86) and (87), the front panel (77) also being disposed vertically and spaced forwardly of the rear panel (76) parallel and a sufficient distance for the passage of the articles (18') therethrough. At the lower end of the rear section (26), a downwardly and outwardly slanted passage (85)(FIG. 2) is formed for the articles (18') to be selectively discharged by means of the panel (64), forming a ceiling for the passage, and the flat surface (88) of the article release unit (29) forming the floor of the passage (85). At both article release ends (21),(27), the articles (18)(18') drop by gravity to a conventional anti-theft compartment (not shown) for retrieval by the purchasers.

To impede the downward free fall of the articles (18') within the second track unit rear section (26), the front and rear panels (81),(76) are offset at vertically spaced locations (89),(91),(92), each offset location comprising offset portions (93),(94) of the panels (81),(76), which portions (93),(94) are also parallel as the remainder of the main parts of the panels (81),(76). By this arrangement of offsets (89),(91),(92), each article (18') takes a zig-zag path downwardly within the rear section (26),moving sequentially against a rear panel portion (94)(FIG. 2) of one offset (89), a front panel portion (96) of the front panel (81), then rearwardly against the portion (94) of the next lower offset (91), etc.

The lower article release unit (29)(FIG. 2) is suspended at the lower end of each column (14-16) by a pair of laterally extended rods (53'') and (54') mounted across the cabinet (12) in the same manner as rods (53') and (54).

As the article release units (28),(29) are identical, even though mounted in opposite inverted manners (FIG. 2), only one will be described, the function of each unit (28),(29) also being identical. The unit, (28) for example, comprises a mounting bracket (101), a finger unit (102), and an electric actuating unit (103) connected in any conventional manner and circuitry for selective operation of the actuating unit (103) for vending the articles (18) held in the particular column (14), for example. In the particular instance of this article dispensing machine (10), it is electrically connected as by slave conduits to another machine (not shown), the latter including coin operated merchandise selecting mechanisms, whereby operation of the latter unit activates the instant machine (10).

Figure 3:
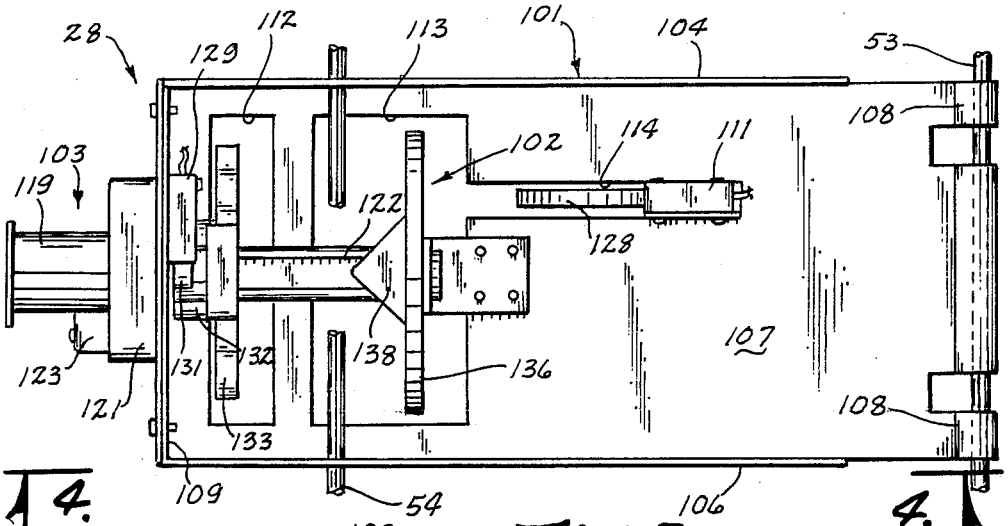
FIG. 3 is an enlarged plan view of an article release unit as taken along the line 3—3 in FIG. 2.

The bracket (101) includes a U-shaped element having upturned sidewalls (104),(106)(FIGS. 3 and 4) and a relatively flat member (107) which forms the upper wall or ceiling of the article passage (105) shown at the lower article dispensing end (21) in FIG. 2, the bottom surface of the member (107) being the surface (56) described hereinbefore. The end of the member (107) has a loop (108) shape such that it can be looped about the rod (53'), and the outer end (109) is bent upwardly to provide a support wall for the bracket (101).

To accommodate the finger unit (102) and a sold-out switch unit (111), the mounting bracket flat member (107) has a plurality of openings (112),(113),(114)(FIG. 3) formed therein whereby fingers and switches detailed hereinafter can move from positions above the articles in the passage (85) to lowered positions engaging the said articles (18). Additionally, a pair of transversely opposed L-shaped slots (116)(FIG. 4) are formed in the sidewalls (104),(106) such that by proper positioning by the bracket (101) between the panels (31),(32), the rod (54)(FIG. 4) will be received within the slots (116) and located rearwardly therein such that, with the loop (108) engaging rod (53'), the bracket (101) is securely suspended in place.

Figure 7:
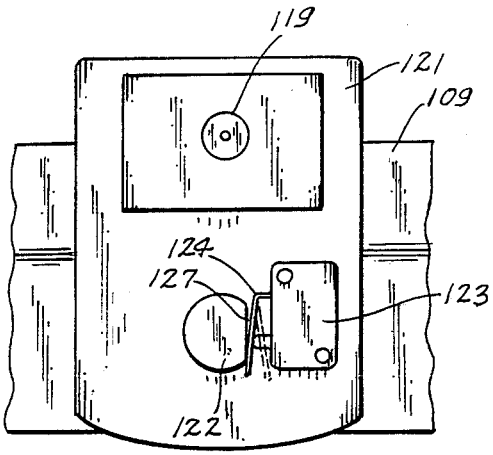
FIG. 7 is a view taken along the line 7—7 in FIG. 4.
Figure 8:
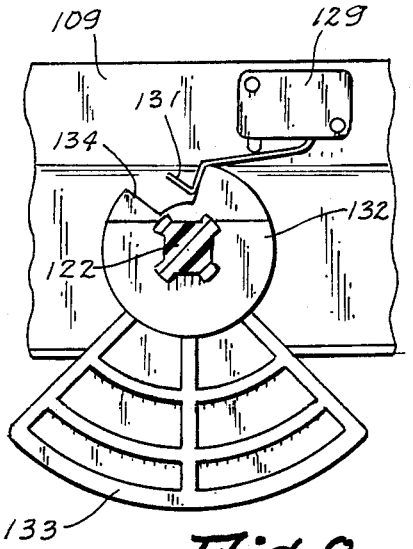
FIG. 8 is a view taken along the line 8—8 in FIG. 4.
Figure 9:
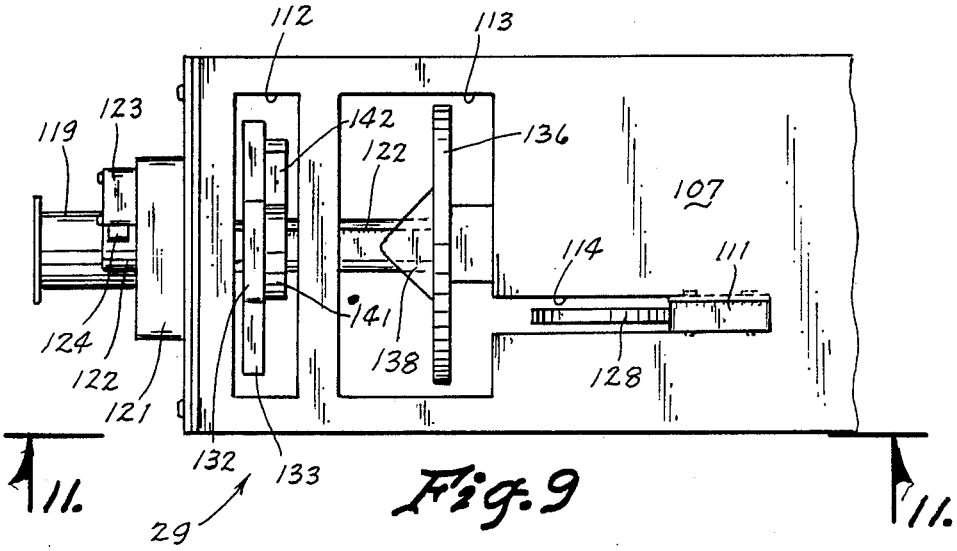
FIG. 9 is a view taken along the line 9—9 in FIG. 2.

The actuating unit (103) comprises a conventional fractional horse power motor (119) with gearing (121) for rotating a drive shaft (122) connected to the finger unit (102) and including further a drive motor cycle switch (123)(FIG. 7) electrically connected to the customer activating machine (not shown) with a leaf spring (124) biased with a land (127) formed on the shaft (122), this for ensuring a full 360° cycle of rotation for the shaft (122) for each article selection. Further, the actuating unit (103) includes the sold-out switch override switch unit (129) having a leaf (131)(FIG. 8) biased toward another cam (132) formed integral with a finger (133), the cam (132) having a notch (134) formed therein. The switch units (111) and (129) act in concert in a conventional manner to indicate a track unit sold out—empty of articles (18) only when the leaf (128)(FIG. 4) is down—there being no article thereunder, and with the leaf (131)(FIG. 8) also down within the notch (134).

More particularly, the finger unit (102) comprises the semi-circularly formed finger (133) formed integrally with the cam (132), and mounted forwardly on the drive shaft (122), the latter having a four-sided shape in cross section (FIG. 8) to enable a frictional slip-on and driving connection with the finger (133); the finger unit (102) comprising further the finger (136),(FIG. 4) mounted on the shaft (122) rearwardly of the front finger (133).

The fingers (133),(136) are spaced apart on the shaft (122) at least the full diameter of an article (18'), or the full length of an article longitudinally of the passage (105). It will further be noted that the lead finger (133) extends approximately 180° radially from the rear finger (136) when the latter is in its normal position with its radial midpoint extended straight upwardly. Also, in those relative arcuate positions, the full arcuate extent of the fingers (133),(136) is at least substantially a full circle.

In operation, when the vending machine user has made his/her selection and deposited the coin in the main machine (not shown), the motor (119) of this article dispensing machine (10) is energized resulting in the drive shaft (122) being rotated a full 360° rotation, after which continued coin deposits will affect a succession of 360° arcuate movements of the finger unit (102). Thus, as the shaft (122) and the fingers (133),(136) rotate from their normal positions of FIG. 4 to a 180° arcuately moved position, the lead finger (133)(FIG. 2) is above the path of the articles (18) and the rear finger (136) has been rotated into their path, the lead article (18) is released to fall downwardly as indicated in FIG. 2, toward a discharge area while the next article (18*a*) is held in place.

Figure 4:
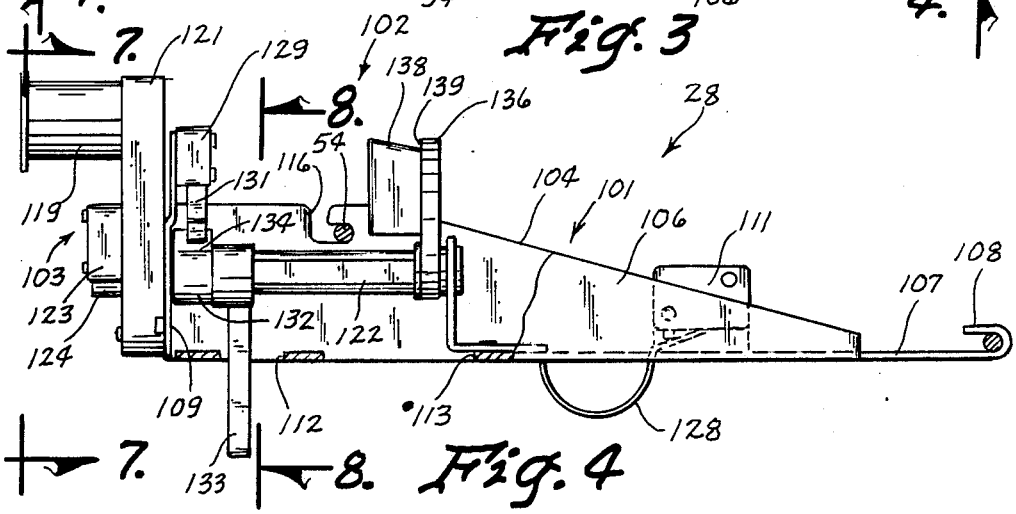
FIG. 4 is a side elevational view of the article release unit of FIG. 3, as taken along the line 4—4 in FIG. 3.
Figure 5:
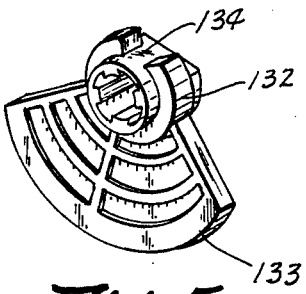
FIG. 5 and 6 are perspective views of parts of the article release unit of FIGS. 3 and 4.

Continued rotation of the finger unit (102) to complete the 360° arcuate movement then results in the rear finger (136) releasing the article (18*a*), permitting it to roll forwardly to the next station where it is blocked by the lead finger (133), the fingers (133),(136) having rotated to their original "normal" position (FIGS. 2 and 4). The sold-out switch leaf spring (128) remains upwardly moved, or actually depressed so long as a article engages it, thus operating in conjunction with the override switch (129) to indicate a supply of articles (18).

It should be noted that the fingers (133),(136) are longitudinally movably adjustable on the shaft (122), and of course any of the slot openings (112–114) can be enlarged or modified within the flat member (107) to accommodate articles (18), of different shapes and diameters which can then be vended using the structure described hereinbefore.

Figure 6:
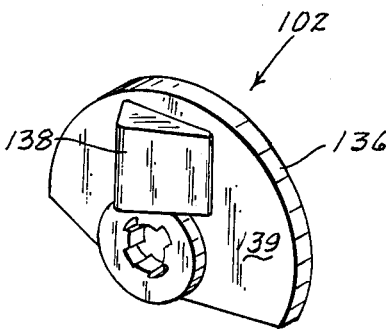
Figure 11:
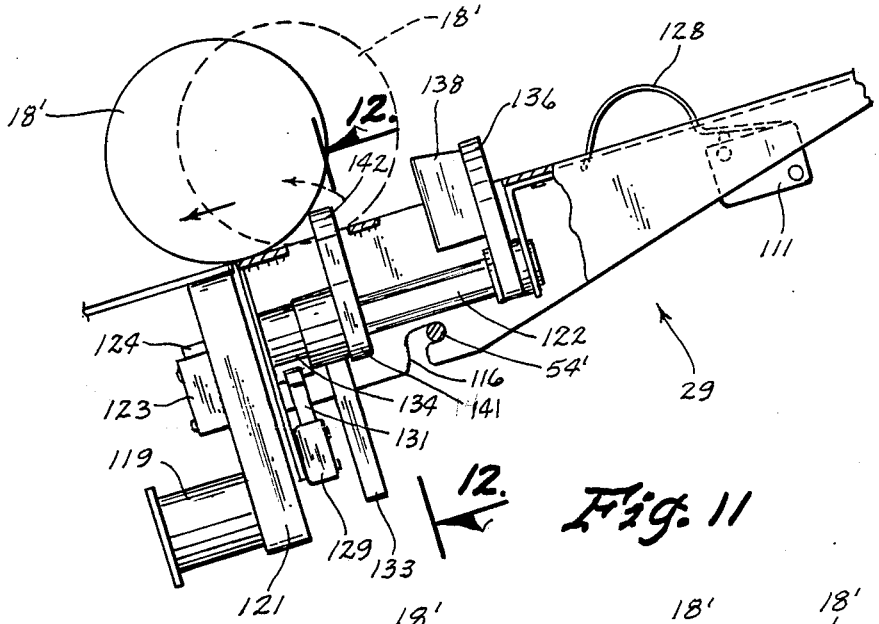
FIG. 11 is a view taken along the line 11—11 in FIG. 9.

To aid in the release and discharge of articles (18) from the release unit, the rear finger (136) may be provided with a ramp (138)(FIGS. 6 and 11) formed on the lead face (139) of the finger (136) at an arcuate location thereon such that if an article (18) has not rolled forward for any reason after release thereof by the lead finger (133), the ram will engage and "kick" the article (18) forwardly upon its normal 180° rotation to an article-blocking position.

Figure 10:
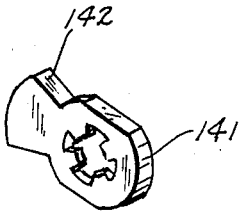
FIG. 10 is a perspective view of a part of the article release unit of FIGS. 3 and 4.
Figure 12:
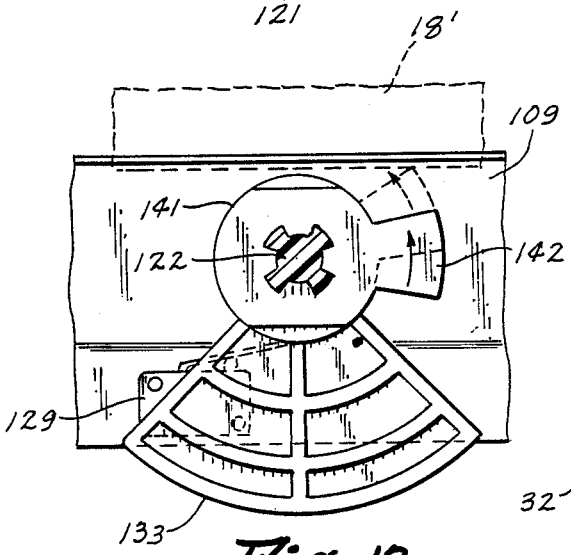
FIG. 12 is a view taken along the line 12—12 in FIG. 11.

Further, a "lifter" cam (141)(FIGS. 10,11 and 12) can be added to the lead finger (133) of either unit (28),(29), the lower article release unit (29), for example, by being integral therewith or separate therefrom but mounted on the shaft (122) in a contiguous relationship. The lifter cam (141) has an extended portion (142)capable of rotating up from below an article (18')(FIG. 11) hung up or binding in some manner on the surface (88) of the member (107) of unit (29), and actually lifting the article (18') to nudge it forwardly, alone or in conjunction with action of the kicker ramp (138)(FIG. 11) thus aiding gravity in the release of the article (18')

While the invention has been described with reference to a particular embodiment, with suggested modifications, changes or other modifications may also be suggested to those skilled in the art without departing from the inventive concept or scope of the appended claims.

We claim:

1. In an article dispensing machine:

a cabinet including one or more vertically disposed columns;

each column including a first serpentine track unit having an upper article receiving end and a lower article dispensing end, each column including further a second track unit having an upper serpentine section disposed above said first serpentine track unit and having an upper article receiving end, and having further a rear track section connected to said upper serpentine section and disposed behind said first serpentine track unit and having a lower article dispensing end, said rear track section substantially straight and normally vertically disposed, and disposed normally behind substantially the entire vertical extent of said first serpentine track unit; and article release units secured to said cabinet means at said lower ends of said first serpentine track unit and said second track unit for controlling the dispensing of articles therefrom.

2. An article dispensing machine as described in claim 1, and further wherein said first serpentine track unit has serpentine track sections overlying each other in contiguous relationship.

3. An article dispensing machine as described in claim 1, and further wherein said rear track section has offset portions formed therein guiding the articles in a zig-zag path downwardly within said rear track section to impede the movement of the articles therethrough.

4. An article dispensing machine as described in claim 3, said rear track section having front and rear walls, said offset portions formed in said walls for guiding the articles moving downwardly through said rear track section sequentially against said front and said rear track walls whereby to impede the movement of the articles through said rear section.

5. An article dispensing machine as described in claim 1, and further wherein said article release units is operable to release an article from a held position, and includes a rotatable cam unit selectively engageable with a rearward end of each article for supplementing the gravity fall of each article.

6. An article dispensing machine as described in claim 5, and further wherein each said article release unit includes a floor over which the articles move for dispensing purposes, and includes further a rotatable lift device selectively engageable with an underside of each article for lifting each article above said floor simultaneous with releasing said lifted article for aiding the gravity release of said lifted article.

7. An article dispensing machine as described in claim 1, and further wherein said article dispensing unit is operable to release an article from a held position, and includes a rotatable cam unit selectively engageable with a rearward end of each article for supplementing the gravity fall of each article, and further wherein each said article release unit includes a floor over which the articles move for dispensing purposes, and includes further a rotatable lift device selectively engageable with an underside of each article for lifting each article above said floor simultaneous with releasing said lifted article for aiding the gravity release of said lifted article.

* * * * *